US005551574A

United States Patent [19]

Hicks et al.

[11] Patent Number: 5,551,574

[45] Date of Patent: Sep. 3, 1996

[54] METHOD AND APPARATUS FOR CONCENTRATION OF MINERALS BY FROTH FLOTATION

[75] Inventors: Gary W. Hicks, Rolla; William L. Cornell, Salem, both of Mo.

[73] Assignee: The United States of America as represented by the Secretary of the Interior, Washington, D.C.

[21] Appl. No.: 529,813

[22] Filed: Sep. 18, 1995

Related U.S. Application Data

[62] Division of Ser. No. 416,562, Apr. 4, 1995, Pat. No. 5,467,876.

[51] Int. Cl.[6] ..... B03D 1/02

[52] U.S. Cl. ..... 209/164; 209/170

[58] Field of Search ..... 209/164, 170; 210/221.2, 703

[56] References Cited

U.S. PATENT DOCUMENTS 1,235,083 7/1917 Wagner .
2,778,499 1/1957 Chamberlain .
3,339,730 9/1967 Boutin .
4,028,229 6/1977 Dell .
4,186,087 1/1980 Kato .
4,592,834 6/1986 Yang .
4,721,562 1/1988 Barnscheidt .
4,722,784 2/1988 Barnscheidt .
4,735,709 4/1988 Zipperian .
4,851,036 7/1989 Anthes .
4,911,826 3/1990 Harach .

*Primary Examiner*—Thomas M. Lithgow
*Attorney, Agent, or Firm*—E. Philip Koltos

[57] ABSTRACT

A method for the separation of components of a slurry by froth flotation are provided. The apparatus includes a flotation column having a slurry feed for introducing slurry into the flotation column, a bubble generator for generating bubbles of gas at the bottom of the flotation column and a froth overflow at the top of the flotation column for collecting and discharging a froth fraction of the slurry. The central portion of the flotation column includes a plurality of vertically-spaced tail ports disposed alternately on opposite sides of the flotation column for discharging a non-float fraction of the slurry. In addition, a single, fluid-impermeable baffle having at least two edges is associated with each tail port. The baffles are of sufficient size to block the vertical flow in at least 50% of the horizontal cross-sectional area of the flotation column to thereby create a quiescent flow zone in the area of each tail port, wherefrom the non-florable fraction of the slurry is removed.

6 Claims, 3 Drawing Sheets

METHOD AND APPARATUS FOR CONCENTRATION OF MINERALS BY FROTH FLOTATION

This is a division of application Ser. No. 08/416,562 filed Apr. 4, 1995 (now U.S. Pat. No. 5,467,876).

FIELD OF THE INVENTION

The present invention relates to a froth flotation process and apparatus. More particularly, the present invention relates to a froth flotation apparatus having no moving parts which may be employed to selectively separate fine mineral particles from gangue and to a process employing the apparatus.

PRIOR ART

The process of froth flotation is widely employed in the mineral and coal industries for upgrading mined ore or coal. The advantage of this process is that it is simple and inexpensive to operate and extremely versatile in application. Chemical leaching processes, for example, require large amounts of reagents, complicated reactors and generally long reaction times resulting in high capital expense, as well as high operation and maintenance costs. Magnetic separation, as another example, is a relatively inexpensive process, but its application is limited to those ores containing magnetic minerals.

The froth flotation process, on the other hand, can separate almost any mineral from other materials at low cost. Typically, a reagent known as a "collector" is added to the aqueous slurry containing a pulverized ore in order to render a selected mineral of the ore hydrophobic. The selected mineral, which is often the more valuable constituent of the minerals contained in the ore, is then collected by the bubbles generated at the bottom of the flotation machine and is carried to the top of the aqueous slurry to be separated from the rest of the hydrophilic minerals remaining in the slurry.

In general, froth flotation apparatus have numerous moving parts which require regular cleaning and maintenance. Further, these moving parts also require a significant energy input which adds to the cost of the mineral separation process. Also, the throughput to floor space ratio for many froth flotation apparatus is insufficient and thus a large amount of floor space is often required to generate a minimal production of mineral concentrate. Finally, these froth flotation apparatus are expensive to construct often requiring special pumps and/or other apparatus for generation of small gas bubbles.

Several froth flotation apparatus such as these are known in the prior art. For example, U.S. Pat. No. 4,186,087 discloses a method and apparatus for separating substances by froth flotation using bubbles. This method is characterized by allowing the bubbles to ascend through a fluid route in a tube independent of the ambient turbulently flowing liquid and then collecting and separating the substance to be separated from the bubbles at the upper end of the tube. This method and apparatus is said to be useful in the treatment of waste water, industrial effluents or mineral extracts.

U.S. Pat. No. 4,592,834 discloses a froth flotation device including a flotation column which is partially filled with a packing that defines a large number of small flow passages extending in a circuitous pattern between the upper and lower portion of the column. As the introduced air flows upwardly through these flow passages, it is broken into fine bubbles which intimately contact the floatable particles in the aqueous pulp of mineral ore and forms a froth concentrate or float fraction which overflows from the top of the column. Wash water is introduced into the top of the column and flows through the flow passages in the packing countercurrently to the float fraction to scrub entrained, non-floatable particles (e.g., gangue) from the froth concentrate. A tailing fraction containing the non-floatable articles is withdrawn from the bottom of the column.

U.S. Pat. No. 4,725,709 discloses a froth flotation system for separating a mineral fraction from an aqueous pulp containing a mixture of mineral and gangue particles. The apparatus is characterized by the fact that gas bubbles are introduced into the pulp by two different means to generate the froth. One means requires aspiration of water into a stream of pressurized gas, such as air, to form a stream of aerated water which is injected into the lower portion of the pulp-filled vessel. The other means requires sparging of a stream of pressurized gas through a porous wall of one or micro-diffusers located within the vessel. The dual means for generating bubbles is said to produce a significantly higher level of mineral separation.

U.S. Pat. No. 4,851,036 discloses a process and apparatus for beneficiating a mineral ore in a substantially vertical column. The mineral-containing feed is introduced into the column containing at least one baffle, into which there is also introduced a gas at the bottom portion thereof and a liquid through at least one column inlet at the top of the column. The baffle and the rates of introduction of the feed, the gas and the liquid are such as to create relatively high turbulence conditions within the column. The high turbulence conditions are said to give an improved recovery of mineral ore.

U.S. Pat. No. 4,911,826 discloses a system for sparging aerated water into a column for the froth flotation of minerals. This apparatus is characterized by the fact that it includes a plurality of sparger tubes arranged in one or more horizontal planes, either radially toward the column center or parallel to each other from opposite sides of the column. Each sparger pipe includes a mixing tee attached to a water passage and an air passage and a perforated portion provided with a number of small openings. The number and arrangement of the openings is chosen such that the air bubbler exit from the openings and rise in the column substantially evenly distributed over the entire cross-section of the column.

U.S. Pat. No. 4,938,865 discloses a method and apparatus for the beneficiation of mineral ore by flotation whereby a slurry is introduced under pressure into the top of a first column through a downwardly facing nozzle and air is entrained into the slurry forming a downwardly moving foam bed in the first column. The foam bed passes from the bottom of the first column into a second column where the froth and liquid separate, the froth-carrying values floating upwardly and over a weir and the liquid being drained with the gangue. The liquid/froth interface level in the second column is kept above the bottom of the first column, and the air flow rate into the top of the first column is controlled to keep the first column substantially full of foam.

U.S. Pat. No. 4,966,687 discloses an apparatus for the separation of components of a slurry by froth flotation. The apparatus includes a spray bar mounted in the intermediate section of the flotation column for providing a downwardly directed fine mist and at least one spray nozzle mounted in the lower section of the flotation column provided with aerating means.

U.S. Pat. No. 4,971,731 discloses a method and apparatus for generating microbubbles in a flowing liquid stream for use in a froth flotation system. The microbubble generator includes a porous tubular sleeve mounted between the housing and an inner member coaxially therewith to define within the cylindrical interior surface of the housing an elongated air chamber of annular cross section. An aqueous liquid is supplied to the liquid flow chamber of the microbubble generator at a relatively high flow rate and air under pressure is supplied to the air chamber such that air is forced radially inwardly through the porous sleeve to be diffused in the form of microbubbles into the flowing stream.

U.S. Pat. No. 4,981,582 discloses a method and apparatus for the microbubble flotation separation of very fine particles to produce a high purity and a large recovery. This is accomplished by using a high aspect ratio flotation column, microbubbles and a countercurrent flow of washwater to gently wash the froth.

U.S. Pat. No. 5,122,261 discloses a flotation column including a plurality of controlled recycled chambers which cause the non-float fraction to drop down in the main float stream while the desired float fraction travels in the opposite direction. This is accomplished by recycling to continually mix the pulp. Recycle zones are positioned on the periphery of the main passage or flotation zone within chambers located in series along the column. A portion of the slurry is drawn into a recycle zone where it passes downwardly to return to the flotation zone or the main passage through the column to be again swept upwards through the column.

U.S. Pat. No. 5,167,798 discloses a method and apparatus for the microbubble flotation separation of very fine and coarse particles in order to produce a high purity and high recovery efficiency. The apparatus employs microbubbles, recycling of the flotation pulp and countercurrent washwater to gently wash the froth in order to achieve these goals. Also disclosed are processes and apparatus for generating microbubbles for flotation in a highly efficient and inexpensive manner, either using a porous tube or an in-line static bubble generator.

A review of the foregoing references reveals that they all require flotation columns having a substantial number of moving parts. This leads to high maintenance requirement, high energy consumption and high construction costs. Thus, a need exists for an improved froth flotation column which employs a minimum number of moving parts to thereby reduce maintenance, decrease energy consumption and decrease construction costs.

In addition, many of the foregoing apparatus require an additional countercurrent flow of washwater in order to aid in the separation of the gangue from the froth as the mineral slurry flows upwardly in the vertical column. This additional flow of washwater increases the expense of the mineral separation process and it is desirable to eliminate the need for such a stream. Accordingly, there is a need in the art for a froth flotation process and apparatus which does not require an additional wash water stream.

Finally, it has been found that the throughput to floor space ratio of the foregoing froth flotation apparatus is not yet optimized and thus these apparatus require a large amount of floor space and have high construction costs. Accordingly, there is a further need in the art for a froth flotation apparatus which exhibits an improved throughput to floor space ratio to thereby lower construction costs and space requirements for such apparatus.

SUMMARY OF THE INVENTION

The present invention provides a froth flotation apparatus which employs a series of stationary baffles to create the required turbulence for separation of mineral ores from a mineral slurry without requiring a special apparatus for the generation of microbubbles. Each of the stationary baffles is designed to create a quiescent flow zone from which the non-floatable gangue may be removed from the flotation column.

In a first embodiment of the present invention, there is provided a froth flotation apparatus for concentration of minerals by froth flotation of a slurry containing a mixture of mineral particles and gangue particles. The apparatus includes a flotation column defined by an outer wall and having a top portion, a bottom portion and a central portion and being adapted for generally vertical flow of the slurry in the column. Slurry feed means is provided for introducing the slurry into the central portion of the flotation column and bubble introducing means is disposed in the bottom portion of the flotation column. The flotation column also includes a froth overflow means disposed in the top portion of the column and including an outlet for discharging a froth fraction containing the concentrated mineral particles.

The flotation apparatus includes a plurality of vertically-spaced tail ports disposed alternately on opposite sides of the central portion of the flotation column for discharging a non-float fraction (gangue) of the slurry. Associated with each tail port is a single, fluid-impermeable baffle having at least two edges and being angled upwardly with one edge affixed to the outer wall of the flotation column just below the tail port and the other edge being disposed within the area of vertical flow in the central portion of the flotation column. The baffles are of sufficient size to block the vertical flow in at least 50% of the horizontal cross-sectional area of the flotation column to thereby create a quiescent flow zone in the area of each tail port.

A second embodiment relates to a continuous froth flotation process for separating a mineral concentrate from a slurry which contains a non-floatable particulate material in addition to the target mineral. The process includes the steps of introducing the slurry into a vertical flotation column, which column comprises a plurality of fluid-impermeable, vertically-spaced, baffle means disposed above the point of introduction of the slurry in a manner which creates a plurality of quiescent flow zones in the column. A gaseous material is introduced into the vertical flotation column below the point of introduction of the slurry with the rate of introduction of the gaseous material and the slurry, combined with placement of the baffles, being sufficient to create enough turbulence in the vertical column to separate the target mineral from the non-floatable material. The process further comprises the steps of recovering the ore-containing material at an upper portion of the vertical flotation column located above the baffle means and recovering the non-floatable particulate material from the quiescent flow zones in the vertical flotation column.

The apparatus and process of the present invention provide a froth flotation separation process which requires no moving parts thereby reducing maintenance, decreasing energy consumption and decreasing construction costs. In addition, no special pumps or apparatus are necessary for the generation of small bubbles in the apparatus of the present invention and it is not necessary to employ a countercurrent flow of wash water in order to achieve sufficient mineral separation. Finally, the apparatus of the present invention provides the ability to increase the throughput to floor space ratio as compared to prior art froth flotation apparatus, thereby further lowering construction costs and reducing the space required to achieve a predetermined amount of mineral production.

Other objects and advantages of the present invention will be set forth in or will become apparent from the drawing figures and the detailed description to follow.

DESCRIPTION OF THE PREFERRED EMBODIMENTS

Referring now to the figures, all of which depict the same embodiment of the invention, like elements are represented by like numerals throughout the several views.

Figure 1:
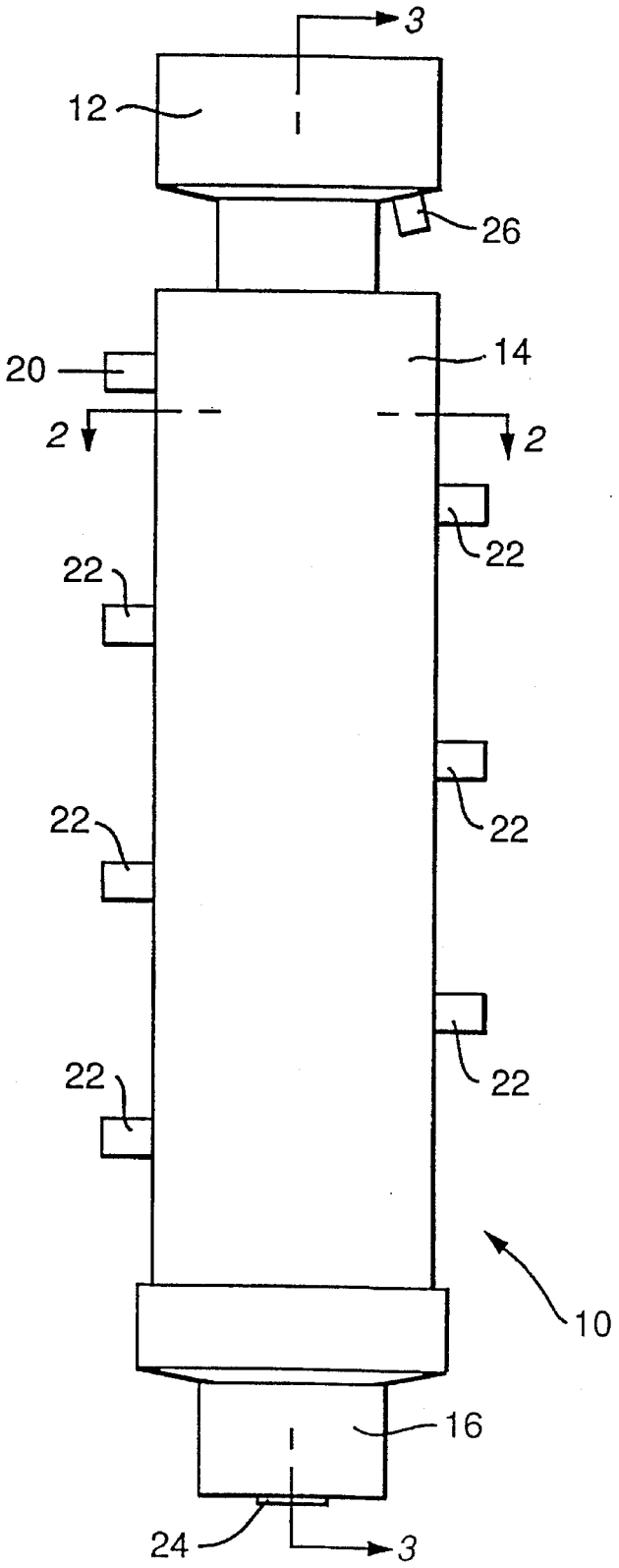
FIG. 1 is a side elevational view of a froth flotation apparatus in accordance with the present invention.

Referring now to FIG. 1, there is shown a froth flotation apparatus 10 in accordance with the present invention. Froth flotation apparatus 10 includes three distinct parts, a concentrate launderer 12, a separation vessel 14 and a gas feed vessel 16.

Concentrate launderer 12 serves as the froth overflow means wherein the mineral-containing froth is separated. Concentrate launderer 12 is provided with a mineral outlet 26 through which concentrated mineral is discharged from froth flotation apparatus 10.

Separation vessel 14 is provided with a slurry inlet 20 for feeding of the slurry containing a mixture of mineral particles and gangue particles to the froth flotation apparatus 10. Separation vessel 14 also includes a plurality of tail ports 22 through which the tailings or gangue particles are removed from separation vessel 14.

Gas feed vessel 16 is provided with a gas inlet 24 for feeding of gas to the froth flotation apparatus 10. Gas inlet 24 is preferably connected to a supply of compressed gas (not shown) such as compressed air.

Figure 2:
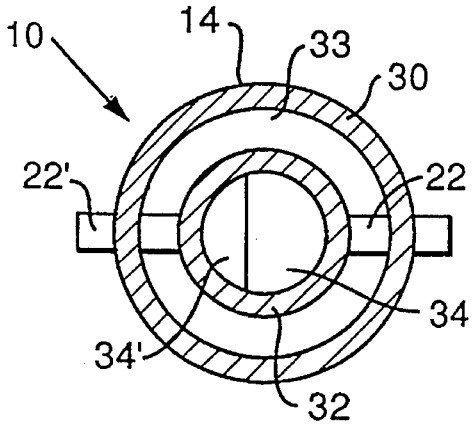
FIG. 2 is a cross-sectional view along lines 2—2 of FIG. 1.

Referring now to FIG. 2, there is shown a cross-sectional view along lines B—B of FIG. 1. In this view, it can be seen that separation vessel 14 includes both a feed column 30 and a flotation column 32 which are arranged concentrically as shown in the figure. The area between feed column 30 and flotation column 32 defines a feed channel 33 which is in fluid engagement with slurry inlet 20 such that mineral slurry fed to separation vessel 14 via slurry inlet 20 arrives in feed channel 33.

The top surface of two different baffles 34 and 34' located within flotation column 32 can also be seen in FIG. 2. The rightmost baffle 34 is located with its outer edge just below the rightmost tail port 22 and rightmost baffle 34 blocks approximately 60% of the vertical flow area in flotation column 32 as shown in the figure. Leftmost baffle 34' is actually located below rightmost baffle. 34 as can be seen from the placement of tail port 22' in FIG. 1, and is positioned just below leftmost tail port 22'. It is not possible to see the entire top surface of leftmost baffle 34' since it is partially obscured by rightmost baffle 34 in FIG. 2.

From FIG. 2, it is also apparent that tail ports 22 and 22' are connected to flotation column 32 such that tailings or gangue can be removed from flotation column 32 through the outer wall of separation vessel 14. There is no fluid connection between tail ports 22 and 22' and feed channel 33 and thus slurry fed into feed channel 33 simply flows around tail ports 22 and 22'.

Figure 3:
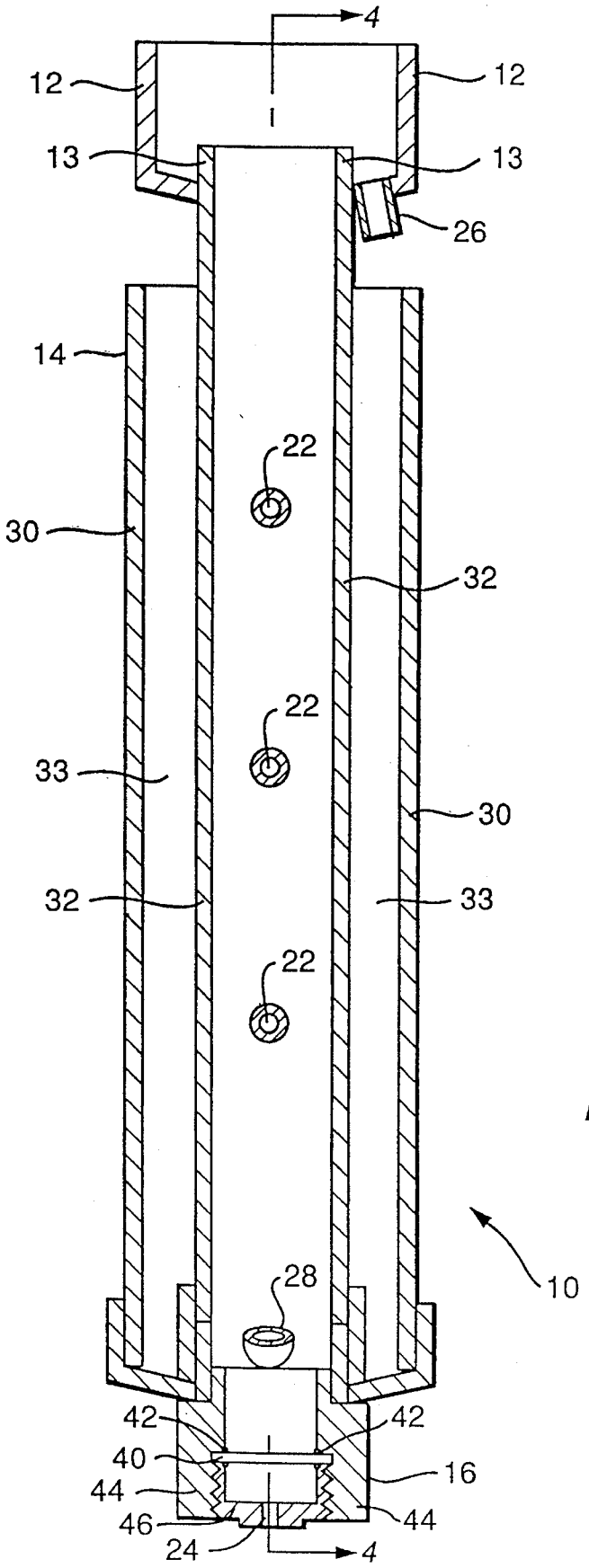
FIG. 3 is a cross-sectional view along lines 3—3 of FIG. 1 wherein the baffles have been omitted to provide a clear view of the tail ports.

Referring now to FIG. 3, there is shown a cross-sectional view along lines A—A of FIG. 1. Baffles 34 and gas baffles 36 have been omitted from FIG. 3 for the sake of clarity. FIG. 3 shows the internal arrangement of the tail ports 22 on one side of separation vessel 14. In addition, it can be seen in FIG. 3 that feed channel 33 runs the entire length of feed column 30.

FIG. 3 also depicts details of concentrate launderer 12. In particular, concentrate launderer 12 includes a weir 13 which extends upwardly beyond the bottom of concentrate launderer 12. In operation, froth flows upwardly through flotation column 32 and over weir 13 to where it is collected in the bottom of concentrate launderer 12. From there, the froth is discharged from concentrate launderer 12 via mineral outlet 26. The product removed via mineral outlet 26 is the desired product from froth flotation apparatus 10.

FIG. 3 also depicts details of gas feed vessel 16 which is formed from an outer wall 44 and a bottom wall 46, each of which is designed to mate with the other in order to form the integral gas feed vessel 16 shown in the figure. Bottom wall 46 includes the gas inlet 24 which, as stated, may be connected to a source of compressed gas (not shown). Bottom wall 46 may be removed from outer wall 44 for insertion and/or replacement of perforated plate 40. Perforated plate 40 is held in place by two O-rings 42 disposed above and below perforated plate 40 as shown in the figure. Perforated plate 40 may be a fritted disk made of porous glass, fiberglass or other porous material.

Figure 4:
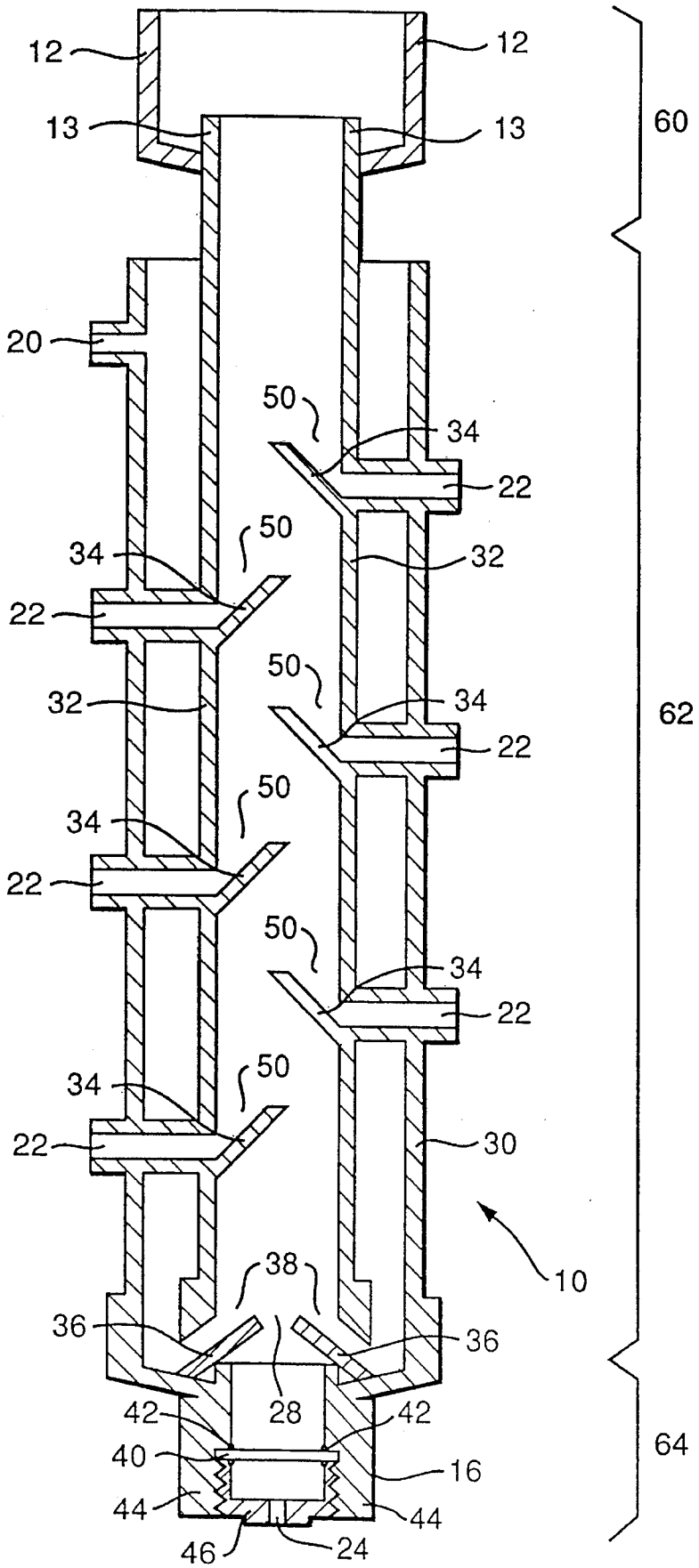
FIG. 4 is a cross-sectional view along lines 4—4 of FIG. 3 wherein the baffles are included.

In FIG. 4 are shown further details of the apparatus of FIGS. 1–3. Gas baffles 36 are located at the bottom of the central portion 62 of flotation column 32. Gas baffles 36 create a gas channel 28 which is a flow constriction that increases the pressure and velocity of the gas flow in the vertical direction. Gas baffles 36 are preferably placed adjacent to the underside of column inlet 38 such that the high velocity gas bubbles will immediately contact incoming mineral slurry from feed column 30 whereby it arrives in feed channel 33.

Froth flotation column 10 is divided into a top portion 60, a central portion 62 and a bottom portion 64. The baffles 34 are attached to the outer wall of the central portion 62 flotation column 32 just below each tail port 22. Baffles 34 are fluid-impermeable such that the vertical flow of fluid through flotation column 32 must pass around each of the baffles 34. Baffles 34 are angled upwardly as shown in FIG. 4 in order to create a quiescent zone 50 in the vicinity of each tail port 22. Each quiescent zone 50 is a zone of little or no vertical flow where gangue (or tailings) can settle out of the upwardly flowing slurry. Each of the baffles 34 preferably blocks at least 50% of the horizontal-cross-section of flotation column 32. In this manner, the vertical flow is redirected and constricted thereby increasing its velocity and creating turbulence along the edges of baffles 34. More preferably, baffles 34 block at least 60% of the horizontal cross-sectional area of flotation column 32.

In operation, a slurry containing mineral ore and gangue is fed through slurry inlet 20 in feed column 30. Preferably, sufficient mineral slurry is fed to maintain the height of the mineral slurry in feed column 30 at approximately the same level as slurry inlet 20. In this manner, the weight of the mineral slurry in feed channel 33 will, under the influence of gravity, provide a force which will aid in feeding mineral slurry through column inlet 38 into flotation column 32.

At the same time, compressed gas is fed to gas feed vessel 16 through gas inlet 24. The compressed gas passes through perforated plate 40 whereby it is converted to gas bubbles. The gas bubbles are then forced upwardly by the pressure of the incoming compressed gas and passed through gas channel 28 whereby they acquire additional pressure and velocity. The upward movement of the gas bubbles serves to create a partial vacuum in the vicinity of column inlet 38 which aids in drawing the incoming mineral slurry upwardly through flotation column 32. In addition, the pressure differential obtained by the rise of gas bubbles through the liquid present in flotation column 32 also serves to aid movement of the slurry in an upward direction.

Through the use of conventional chemical reagents (so-called, "collectors") which are applied to the target mineral's surface, the mineral is rendered hydrophobic and thus amenable to flotation by attachment to the rising gas bubbles. In this manner, the target mineral is entrained in the rising gas bubbles and thereby carried upwardly through flotation column 32.

As the gas bubbles, including the entrained mineral, move upwardly through flotation column 32, they encounter baffles 34 which redirect the flow and constrict the flow area thereby creating turbulence in flotation column 32. This turbulence retards bubble coalescence and acts to separate entrained gangue particles or tailings flowing with the gas bubbles. The separated gangue particles will fall downwardly and tend to settle in the quiescent zones 50 while the entrained target mineral will continue upwardly along with the gas bubbles. The gangue or tailings are then removed from quiescent zones 50 of flotation column 32 via tail ports 22.

The target mineral will be carried upwards by the rising gas bubbles creating a mineralized froth which passes over weir 13 in concentrate launderer 12 and collect in the bottom of concentrate launderer 12 wherefrom it is discharged via mineral outlet 26.

By precisely controlling the slurry density, slurry level, slurry feed rate, gas flow rate, tailings outflow rate and the dimensions of the apparatus, the apparatus and process of the present invention can be applied to a wide variety of different ores. Further, due to its high throughput potential and low energy requirements, as well as its capability for fine particle separation, the device of the present invention is particularly suited to the processing of finely ground, low grade ores and for the reprocessing of tailings.

The preferred froth flotation apparatus 10 of the present invention employs a central portion 62 of separation vessel 14 which has a height to diameter ratio of at least 8 and, more preferably, 10. In addition, the diameter of feed column 30 is preferably 1.5 to 2.5 times the diameter of flotation column 32 and most preferably twice the diameter of flotation column 32. Further, the diameter of tail ports 22 and column inlet 38 are approximately 1/10 the diameter of flotation column 32.

Gas baffles 36 are preferably angled at an angle of from 20–30 degrees and more preferably at an angle of 22.5 degrees to the horizontal and thereby provide a flow constriction which, combined with the bubble-introducing action of perforated plate 40, renders the specialized pumps and microbubble generating apparatus of prior art devices unnecessary. Baffles 34 are preferably angled at an angle of at least 30 degrees to the horizontal and more preferably at an angle of about 45 degrees to the horizontal. In the most preferred embodiment shown in FIG. 4, baffles 34 are evenly spaced along the vertical length of flotation column 32 and attached to alternate sides of flotation column 32 such that the vertical flow is redirected by each baffle 34.

The foregoing description of the invention has been presented for the purpose of illustration and description only and is not be construed as limiting the invention in any way. The scope of the invention is to be determined from the claims appended hereto.

What is claimed is:

1. A continuous froth flotation process for separating a target mineral from a slurry of mineral ore which also contains a non-floatable particulate material, said process comprising the steps of:

a) introducing the slurry into a vertical flotation column comprising a plurality of fluid-impermeable, vertically-spaced baffles disposed above the point of introduction of the slurry B1 and arranged in a manner which creates a plurality of quiescent flow areas in the flotation column B2;

b) introducing a gaseous material into the vertical flotation column below the point of introduction of the slurry; the rate of introduction of the gaseous material and slurry combined with the placement of the baffles being sufficient to create sufficient turbulence in the vertical column to separate the target mineral from the non-floatable material;

c) recovering the target mineral concentrate at an upper portion of the vertical flotation column located above the baffles; and d) recovering the non-floatable particulate material from the quiescent flow zones in the vertical flotation column.

2. A process as claimed in claim 1 further comprising the step of passing the gaseous material through a perforated plate in order to produce gas bubbles from the gas before to its introduction to the vertical flotation column.

3. A process as claimed in claim 2 further comprising the step of constricting the flow of the gaseous material below the point of introduction of the slurry to the vertical flotation column.

4. A process as claimed in claim 3 wherein the slurry is introduced to the vertical flotation column from a concentric slurry feed column by gravity acting on the slurry.

5. A process as claimed in claim 4 wherein the gaseous material comprises compressed air.

6. A process as claimed in claim 5 wherein the slurry comprises water.

* * * * *